United States Patent [19]

Ödman

[11] 4,389,796

[45] Jun. 28, 1983

[54] HEAT EXCHANGER

[75] Inventor: Rolf R. Ödman, Malmberget, Sweden

[73] Assignee: Luossavaara-Kiirunavaara Aktiebolag, Stockholm, Sweden

[21] Appl. No.: 239,189

[22] Filed: Mar. 3, 1981

[30] Foreign Application Priority Data

Mar. 5, 1980 [SE] Sweden ..... 8001749

[51] Int. Cl.[3] ..... F26B 17/14

[52] U.S. Cl. ..... 34/168; 34/174; 34/242

[58] Field of Search ..... 34/168, 57 A, 57 R, 34/242, 13, 20, 174; 432/115, 242, 78, 79; 165/154, 111

[56] References Cited

U.S. PATENT DOCUMENTS

| | | | |
|---|---|---|---|
| 2,703,936 | 3/1955 | Hut | 34/168 |
| 3,836,131 | 9/1974 | Beggs . | |
| 3,963,416 | 6/1976 | Mach | 432/115 |

FOREIGN PATENT DOCUMENTS

| | | | |
|---|---|---|---|
| 2229810 | 1/1974 | Fed. Rep. of Germany . | |
| 2742297 | 3/1979 | Fed. Rep. of Germany | 34/168 |
| 1497283 | 10/1967 | France . | |
| 2024620 | 8/1970 | France . | |
| 606143 | 6/1960 | Italy | 34/168 |
| 837175 | 6/1960 | United Kingdom | 34/168 |

*Primary Examiner*—Larry I. Schwartz

*Attorney, Agent, or Firm*—Fleit, Jacobson & Cohn

[57] ABSTRACT

A heat exchanger for heat exchange between downwardly flowing solid particulate material and a gas comprises a substantially conical casing having arranged at the bottom thereof a tubular outlet for material having undergone heat exchange. A tube extends downwardly into the casing substantially symmetrically about the vertical axis thereof and forms an outer defining wall of an annular inlet through which material to be treated is charged to the interior of the casing. Extending through the tube co-axially therewith is a gas inlet having a gas inlet pipe which extends down into the casing and which forms an inner defining wall of the annular material inlet. The gas inlet pipe has a discharge orifice located at a given distance beneath the discharge orifice of the material inlet, and a collecting chamber for gas having undergone heat exchange and arranged at the top of the casing is laterally defined by the wall of the tube and the wall of the casing, and is provided with a gas outlet.

6 Claims, 1 Drawing Figure

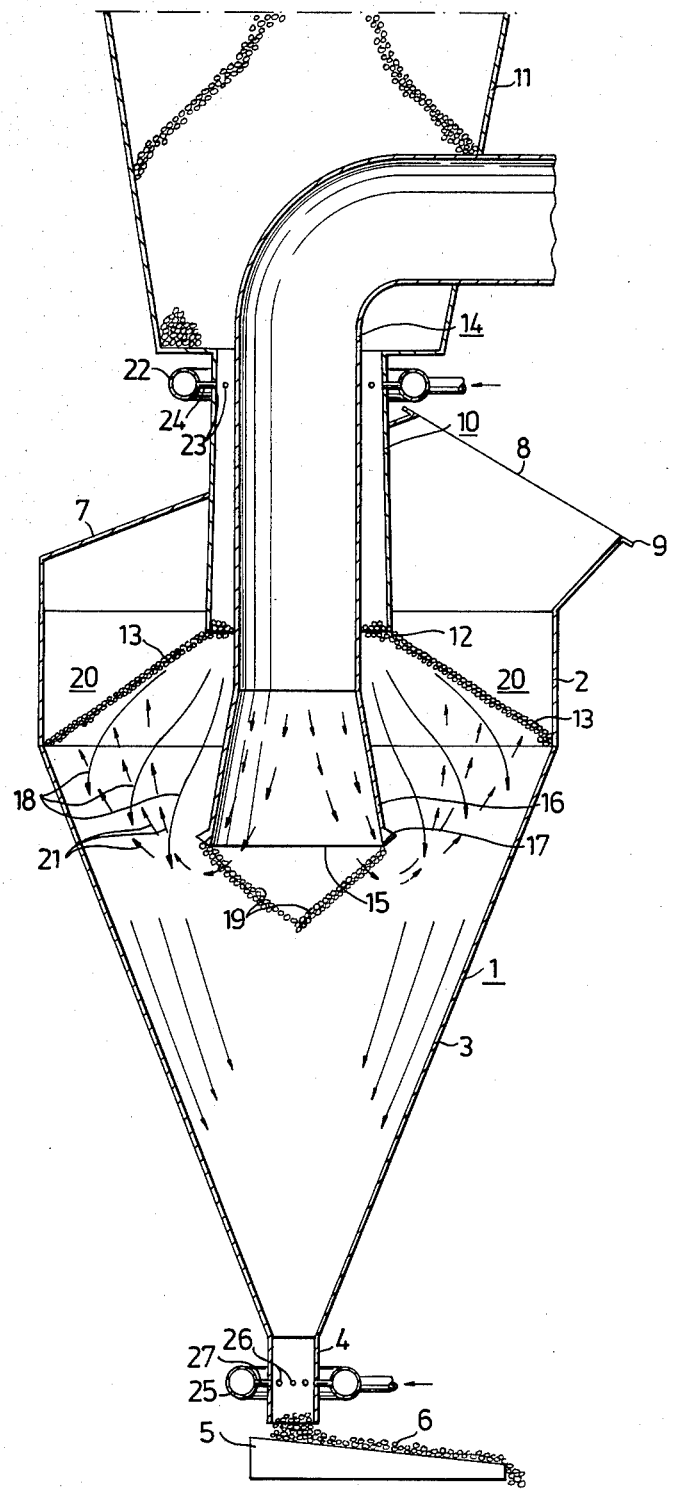
11
14
22
24
23
10
8
7
9
13
12
20
20
2
13
18
16
21
17
15
19
1
3
26
4
27
25
5
6

HEAT EXCHANGER

The present invention relates to a heat exchanger for heat exchange between downwardly flowing solid particulate material and a gas, of the kind which comprises a casing having substantially circular shape in horizontal cross-section and an outlet for material having undergone heat exchange arranged at the bottom thereof; a material inlet discharging into the casing and being substantially symmetrical about the vertical axis of the casing; a gas inlet arranged within the interior of the casing beneath said material inlet and being substantially symmetrical about the vertical axis of the casing; and a collecting chamber for gas having undergone heat exchange, said chamber being located at the top of the casing and provided with gas outlet means.

A heat exchanger of this kind is normally used for cooling particulate or lump material, for example pellets arriving from a pellet sintering plant or a direct-reduction plant. Examples of such heat exchangers used for cooling particulate material are found illustrated and described in, for example, U.S. Pat. No. 3,836,131 and German Offenlegungsschrift No. 2 229 810. One disadvantage with these known coolers, however, is that channeling, as a result, for example, of wall effects, or as a result of the local damming of material above mounting elements or transversely extending cooling-gas supply lines within the casing, cannot effectively be avoided. Because of this the exchange of heat is uneven and incomplete, since the cooling gas, due to its expansion and increased viscosity when heated, has a natural tendency to pass along zones of material which have already been cooled. For this reason, the gas which passes through the heat exchanger will only be heated to a relatively low temperature, thereby limiting the possibility of recovering heat rationally from said gas.

Other examples of such known heat exchangers are found described and illustrated in French Patent Specification Nos. 1 497 283 and 2 024 620. French Patent Specification No. 1 497 283 proposes a heat exchanger in which at least part of the particulate material is charged outside the gas-collecting chamber, rendering it difficult to control the inflow of material, and in which gas is introduced from the lower part of the casing through a pipe which is co-axial with the material outlet, thereby necessitating the provision of complicated outfeed equipment. In the heat exchanger proposed by French Patent Specification No. 2 024 620, the particulate material is charged to an annular chamber, the upper part of which simultaneously serves as the gas-collecting chamber. The annular chamber is arranged for rotation about its vertical axis, to provide uniform dispersion of the charged material. In addition to its complicated design, the heat exchange of this French Specification is also encumbered with the disadvantage exhibited by the heat exchangers known from the above-discussed U.S. and German Specifications.

An object of the invention is to provide a novel and useful heat exchanger in which the aforedescribed disadvantages are at least substantially avoided.

Accordingly, this invention consists in a heat exchanger for heat exchange between downwardly flowing solid particulate material and a gas, comprising a substantially conical casing having arranged at the bottom thereof a tubular outlet for material having undergone heat exchange; a tube extending downwardly into the casing substantially symmetrically about the vertical axis thereof and forming an outer defining wall of an annular material inlet; a gas inlet means comprising a gas inlet pipe which extends down into the casing through said tube co-axially therewith and which forms an inner defining wall of said annular material inlet, said gas inlet pipe having a discharge orifice located at a given distance beneath the discharge orifice of the material inlet; and a collecting chamber for gas having undergone heat exchange, said chamber being laterally defined by the wall of said tube and the wall of said casing and being provided with gas outlet means. By means of this arrangement there is provided, with the aid of simple means from the aspect of manufacturing technology, a guarantee that all material fed through the annular material inlet will come into contact with the gas passing from the gas inlet to and through said gas collecting chamber. Further, removal of material from the heat exchanger can be effected in a simple fashion, since the material is discharged through a tubular outlet, while the absence of obstacles within the casing ensures a uniform downflow of material. Although the heat exchanger is primarily intended for cooling hot particulate or lump material with a preferably cold gas, it will be understood that it can also be used for the exchange of heat between cold particulate material and a hot gas.

To create a favourable flow pattern for the particulate material undergoing a heat exchange, and to present to the gas flow a greater area of particulate material, the gas inlet pipe may be flared, preferably conically, downwardly and outwardly, at least in the region thereof located beneath the discharge orifice of the material inlet, thereby to create an obliquely outwardly directed movement of the material along the tubular gas inlet.

For the purpose of achieving heat exchange to a high degree of completeness, the discharge orifice of the gas inlet pipe is suitably located beneath the discharge orifice of the material inlet at a distance therefrom which is approximately equal to or greater than the radial distance between the discharge orifice of the material inlet and the wall of the surrounding casing.

Further, to avoid undesirable leakage of air or other gas into and out of the heat exchanger casing there is conveniently provided means for supplying a sealing gas to the material inlet, and means for supplying a sealing gas to the material outlet.

The invention will now be described in more detail with reference to the accompanying drawing, the single FIGURE of which is a vertical sectional view of a preferred embodiment of a heat exchanger according to the invention.

The illustrated heat exchanger will be described with reference to the cooling of a material in the form of hot pellets, e.g. hot, sintered iron-ore pellets or direct-reduced pellets, with, for example, a relatively cold gas, which may be air in the case of sintered pellets and an inert or reducing gas in the case of direct-reduced pellets.

The illustrated heat exchanger comprises a casing shown generally at 1, having a cylindrical upper part 2, a conical intermediate part 3 and a tubular under part 4 which is also cylindrical and which forms an outlet for pellets which have been cooled by the exchange of heat with cold gas within the casing 1. Arranged beneath the outlet 4 is a schematically illustrated conveyor 5 for carrying away the cooled material 6.

Mounted on the upper part of the casing 1 is a hood 7 having arranged therein an outlet opening 8. Extending around the opening 8 is a flange 9 for facilitating connection of the hood 7 to a line (not shown) for passing the gas utilized for heat exchange purposes in the casing 1 and heated in the process thereof, to, for example, a heat recovery plant.

Projecting centrally into the upper part 2 of the casing 1 is an inlet for material 6 to be cooled. The inlet includes a tube 10 of circular cross-section and extends downwardly from the bottom of a bunker 11 containing a supply of material 6, through the hood 7, and is terminated in a downwardly facing orifice 12. The material 6 is permitted to pass freely into the interior of the casing 1 as cooled material 6 is removed through the material outlet 4, and hence the location and slope of the upper side 13 of the charge of material present in the casing 1 is determined by the material angle of repose of the material 6 and the location of the orifice 12.

Gas for cooling the material 6 entering the casing 1 is supplied through a gas inlet in the form of a pipe 14 of circular cross-section which extends down through the tube 10 co-axially therewith, and terminates in a downwardly facing orifice 15 beneath the orifice 12 and at a distance therefrom. As will be evident from the aforesaid, the material inlet is of annular cross-sectional shape having an outer defining wall formed by the tube 10 and an inner defining wall formed by the gas inlet pipe 14. The lower part 16 of the gas inlet 14 is flared conically and, as shown, is also provided with a thickened peripheral rim portion 17, partly to create a flow pattern indicated by arrows 18 and favourable to the material 6, and partly to increase the surface area 19 where the cold gas entering through the inlet 14 can penetrate into the material 6, said surface 19 also being enlarged by the angle of repose of the material 6. It has been found advantageous in practice to cause the gas inlet 14 to discharge into the casing 1 at a distance beneath the orifice 12 of the material inlet, which distance is substantially equal to or greater than the radial distance between said orifice 12 and the wall of the surrounding casing 1. For the purpose of achieving optimal conditions, tube 10 and pipe 14 may be axially adjustable relative to one another.

As a result of the manner in which the annular material inlet orifice 12 is formed, there is obtained in the casing part 2, externally of and around the tube 10, an annular collecting chamber 20 for the cold gas entering from the gas inlet 14, said chamber connecting with the hood 7. As a result of the co-axial arrangement of the gas inlet 14 inside the tube 10, and of the arrangement of the gas collecting chamber 20 outside said tube, the cooling gas is caused to pass through practically all parts of the pellet charge located above the gas inlet orifice 15, as indicated by arrows 21. This results in uniform and substantially complete heat exchange between the pellets 6 and the gas, whereby the amount of gas consumed is relatively low with the subsequent need of only relatively small and therewith inexpensive gas circulation system and enables rational recovery of heat from the gas heated by said heat exchange. In a test carried out on a practically full scale (45 tons of material per hour) in conjunction with the cooling of sintered iron-ore pellets in a heat exchanger constructed in accordance with the invention, the temperature of the pellets entering the casing 1 was 499° C. while the temperature of the incoming cooling gas, in this case air, was 1°–5° C. Subsequent to heat exchange in the apparatus, the temperature of the outgoing pellets was 52° C. and the temperature of the outgoing gas 327° C., which gives a good indication of the highly effective heat exchange which can be had with said heat exchanger.

As indicated by the ring line 22 and the distribution lines 24 which discharge at 23, for the purpose of avoiding undesirable leakage of gas into and out of the heat exchanger, means may be provided for supplying minor quantities of sealing gas to the material inlet. Similarly, means may also be arranged for supplying minor quantities of sealing gas to the material outlet 4, as indicated by the ring line 25 and the distribution lines 27 discharging at 26.

As before mentioned, the aforedescribed and illustrated apparatus can also be used for heat exchange between a hot gas, e.g. hot waste gas from soaking pits or from a blast-furnace gas combustion plants, and durable, refractory heat-transporting bodies, such as cold aluminium-oxide pellets. In addition, two apparatus of the kind described can be connected in series, e.g. one upon the other, to form a continuous heat regenerating or recuperating system in which refractory pellets are heated by a hot gas while passing down through the uppermost apparatus and contacted with cold gas (e.g. air) during their passage through the lowermost apparatus, to deliver their heat to said cold gas. The cold gas is continuously removed from the lowermost apparatus and passed to a consumer, e.g. in the case of air to the tuyers of a blast furnace, while the cooled pellets are recycled to the uppermost apparatus. Such an arrangement is of but moderate size compared, e.g. with the conventional Cowper apparatus designs utilized with blast furances, and has an efficiency of from 80°–90°%. Thus when the incoming gas to the uppermost apparatus has a temperature of say 1200° C. the gas departing from the lowermost apparatus will have a temperature of about 1000° C.

It will be understood that the invention is not restricted to the described and illustrated embodiment, but that the embodiment can be modified within the scope of the claims.

I claim:

1. A heat exchanger for heat exchange between downwardly flowing solid particulate material and a gas, comprising a casing having a substantially conical part, and a tubular outlet for material having undergone heat exchange arranged at the bottom of the conical part; a tube extending downwardly into the casing substantially symmetrically about the vertical axis thereof and forming an outer defining wall of an annular material introducing means, said tube having a material inlet orifice at its upper end and a material discharge orifice at its lower end, the lower end of said tube terminating in the upper portion of said casing; a gas inlet means comprising a gas inlet pipe which extends down into the casing through said tube co-axially therewith and which forms an inner defining wall of said annular material introducing means, said gas inlet pipe having a discharge orifice located at a given distance beneath the discharge orifice of the material introducing means; and a collecting chamber for gas having undergone heat exchange, said chamber being laterally defined by the wall of said tube and the wall of said casing and being provided with gas outlet means, said given distance being approximately equal to the radial distance between the discharge orifice of the material introducing means and said casing wall.

2. A heat exchanger according to claim 1, wherein the gas inlet pipe is flared at least in the region thereof located beneath the discharge orifice of the material introducing means, thereby to cause the material to move in an obliquely outwardly direction.

3. A heat exchanger according to claim 2, wherein the gas inlet pipe is widened conically, downwardly and outwardly.

4. A heat exchanger according to claim 1 or 2, wherein means are provided for supplying sealing gas to the material introducing means.

5. A heat exchanger according to claim 1 or 2, wherein means are provided for supplying sealing gas to the material outlet.

6. A heat exchanger according to claim 1, wherein said casing has a cylindrical upper part positioned above the conical part, the cylindrical upper part containing the discharge orifice of the material introducing means and the conical part containing the discharge orifice of the gas inlet pipe, said heat exchanger further comprising a hood mounted on the upper part of said casing, said hood having an opening for passage of said tube and an opening forming said gas outlet means.

* * * * *